US005359740A

United States Patent [19]

Markley et al.

[11] Patent Number: 5,359,740

[45] Date of Patent: Nov. 1, 1994

[54] PATIENT RESTRAINT BED

[75] Inventors: David Markley, Norristown; Margaret Lawler, Lester; Jane Erdman, Lafayette Hill; Timothy Pierson, Bryn Mawr, all of Pa.

[73] Assignee: Bryn Mawr Rehabilitation Hospital, Malvern, Pa.

[21] Appl. No.: 648,557

[22] Filed: Jan. 31, 1991

[51] Int. Cl.[5] ..... A47C 21/08

[52] U.S. Cl. ..... 5/425; 5/512; 5/663

[58] Field of Search ..... 5/424, 425, 93.1, 285, 5/286, 287, 400, 658, 663, 512; 52/285, 585

[56] References Cited

U.S. PATENT DOCUMENTS

| | | | |
|---|---|---|---|
| 231,874 | 6/1974 | Weigel et al. | D6/14 |
| 276,212 | 4/1883 | Bardwell | 5/425 |
| 528,239 | 10/1894 | Schweitzer | 52/585 |
| 842,800 | 1/1907 | Moore et al. | 5/512 |
| 921,114 | 5/1909 | Hudson | 52/585 |
| 949,389 | 2/1910 | Almgren | 5/100 |
| 1,282,292 | 10/1918 | Reuss | 5/97 |
| 1,514,081 | 11/1924 | Hahn | 52/285 |
| 1,557,523 | 10/1925 | Hahn | 52/285 |
| 1,761,301 | 6/1930 | Holderness | 49/464 |
| 1,790,137 | 1/1931 | Downhour | 49/464 |
| 1,820,098 | 8/1931 | Storm | 49/464 |
| 1,925,637 | 9/1933 | Keller | 5/331 |
| 2,014,205 | 9/1935 | Linden | 5/512 |
| 2,059,240 | 11/1936 | Johnston | 5/100 |
| 2,194,230 | 3/1940 | Lewis | 49/464 |
| 2,375,941 | 5/1945 | Nostrand | 5/330 |
| 2,442,048 | 5/1948 | Kroll et al. | 5/93 |
| 2,455,340 | 11/1948 | Newman | 5/331 |
| 2,477,231 | 7/1949 | Bourdon | 5/100 |
| 2,497,453 | 2/1950 | Hazen | 5/93.1 |
| 2,644,173 | 7/1953 | James | 5/331 |
| 2,667,647 | 2/1954 | Reggiani | 5/95 |
| 3,430,272 | 3/1969 | Thorn, Jr. | 5/93 |
| 3,811,139 | 5/1974 | Shaw | 5/82 |
| 4,017,917 | 4/1977 | Brown | 5/60 |
| 4,125,912 | 11/1978 | Courter | 5/286 |
| 4,332,042 | 6/1982 | Koncelik | 5/424 |
| 4,571,904 | 2/1986 | Kessler | 5/93.1 |
| 4,641,387 | 2/1987 | Bondy et al. | 5/508 |
| 4,672,698 | 6/1987 | Sands | 5/424 |
| 4,953,246 | 9/1990 | Matthews | 5/424 |

FOREIGN PATENT DOCUMENTS

| | | | |
|---|---|---|---|
| 957876 | 2/1950 | France | 5/93.1 |

OTHER PUBLICATIONS

The Emory Cubicle Bed: An Alternative to Restraints for Agitated Traumatically Brian Injured Clients, Linda Maher Williams, MN, RN, CRRN; Georgette A. Morton, RN, CRRN; Cornelia H. Patrick, RN, CRRN; Rehabilitation Nursing, vol. 15, No. 1, p. 30, Jan.-Feb. 90.

*Primary Examiner*—Flemming Saether

*Attorney, Agent, or Firm*—James A. Drobile; Robert E. Rosenthal

[57] ABSTRACT

A bed having a mattress and a vertical wall extending about the entire periphery of the mattress. The wall includes lightweight panels disposed in one or more courses. A gate is provided in one section of the wall by gate panels hingedly mounted at one end and latchably mounted at an opposite end. Panels other than gate panels are rigidly mounted in place with respect to one another. Each panel has a rigid structural exterior section and an interior padded section. The padded sections are disposed so that padding is provided over substantially the entire interior side of the wall when the panels are assembled in the walls.

2 Claims, 5 Drawing Sheets

PATIENT RESTRAINT BED

BACKGROUND OF THE INVENTION

This invention relates to beds. This invention also relates to equipment for use in hospitals, particularly rehabilitation hospitals, and other facilities for the care of injured persons. This invention relates particularly to equipment for use in the care of persons who have suffered brain injuries.

In the care of persons who have suffered brain injuries, a variety of specific problems are encountered. Brain-injury patients are generally not aware of their surroundings. They experience various degrees of agitation depending on the type and severity of the injury. Brain-injury patients often retain considerable physical strength. Agitated brain-injury patients may consequently be very difficult to restrain. Agitated brain-injury patients may injure themselves by hitting objects and falling out of bed.

In addition, light and noise may cause certain brain-injury patients to become agitated or increase the degree of agitation of such patients. Consequently, it is desirable to control the level of light and noise to which certain brain-injury patients are exposed. Nurses, physical therapists, and other health care providers must have access to the patient. Facilities must be provided for the care of brain-injury patients by hospitals and the like on very short notice.

Various structures and methods have been provided in the past for restraining brain-injury patients. Restraints such as straps are undesirable because they may cause additional agitation, are uncomfortable, require skin care on a frequent basis, and are time-consuming to apply and maintain. Family members of the patient often object to the use of restraints. Chemical restraints, which are used to reduce agitation, may have various undesirable side effects.

One approach used in the prior art is the providing of beds having walls. A design of such a bed in the prior art has four walls made of plywood, as a structural member, with covered padding on the interior, supported on a flat wooden base. Adjacent walls are attached to one another at corners of the bed by metal hinges. The bed is provided with walls of two different heights. Walls of approximately one foot in height and walls of approximately four feet in height are provided.

Various problems are encountered with the use of this walled bed. The plywood used as a structural member in the walls and the base absorbed moisture. Consequently, patient wastes could enter the plywood, which resulted in unsanitary conditions. Extremely agitated patients could cause the walls of the beds to move in such a manner as to indicate a lack of stability of the walls. The hardware of the metal hinges attaching the walls of the bed at the corners would become damaged after agitated patients had occupied the bed. The appropriate height of bed was not always available for patients. Less agitated patients require only the size of the bed having low walls. More heavily-agitated patients required the size of the bed having high walls. At times, a low-walled bed would be required, while only a high-walled bed was available. The walls and base of a bed, because of their plywood construction, were extremely heavy and cumbersome to move. As a result, two or more men were generally required for assembly of the bed. Brain-injury patients may arrive at a facility at any time. If appropriate members of the maintenance staff are not available for assembly of the bed, the difficulty of assembly of the heavy walls would make it impossible for the nursing staff to assemble the bed. The base and high walls of the bed, because of their size, were inconvenient to store.

Accordingly, it is an object of this invention to provide a bed for a brain-injury patient, which will protect the patient against injuring himself, provide access to caregivers, be easy to assemble, be easy to clean of patient wastes, and be sufficiently strong to accommodate the violently-agitated patient.

It is a further object of this invention to provide a bed for a brain-injury patient, wherein the configuration of the bed may be easily adjusted for particular patients.

Additional objects and advantages of the invention will become apparent from the detailed description of a preferred embodiment which follows.

SUMMARY OF THE INVENTION

A bed according to the invention has a mattress, disposed horizontally, having a horizontal periphery, and a wall, disposed vertically, and extending about all of the periphery of the mattress. The wall has lightweight panels disposed in one or more courses, each one of the panels having a rigid structural section, on a side of the wall facing outward from the mattress, and padding, on a side of the wall facing the mattress, wherein, when the panels are assembled in the wall, the padding is provided over substantially all of the side of the wall facing the mattress, the padding having a washable covering substantially impermeable to moisture, and the rigid structural section having a washable surface substantially impermeable to moisture. The wall has engaging means for removably maintaining adjacent ones of the panels in each course rigidly engaged with respect to one another and vertical alignment means for removably maintaining panels in successive courses in vertical alignment with one another.

DETAILED DESCRIPTION OF A PREFERRED EMBODIMENT

Figure 1:
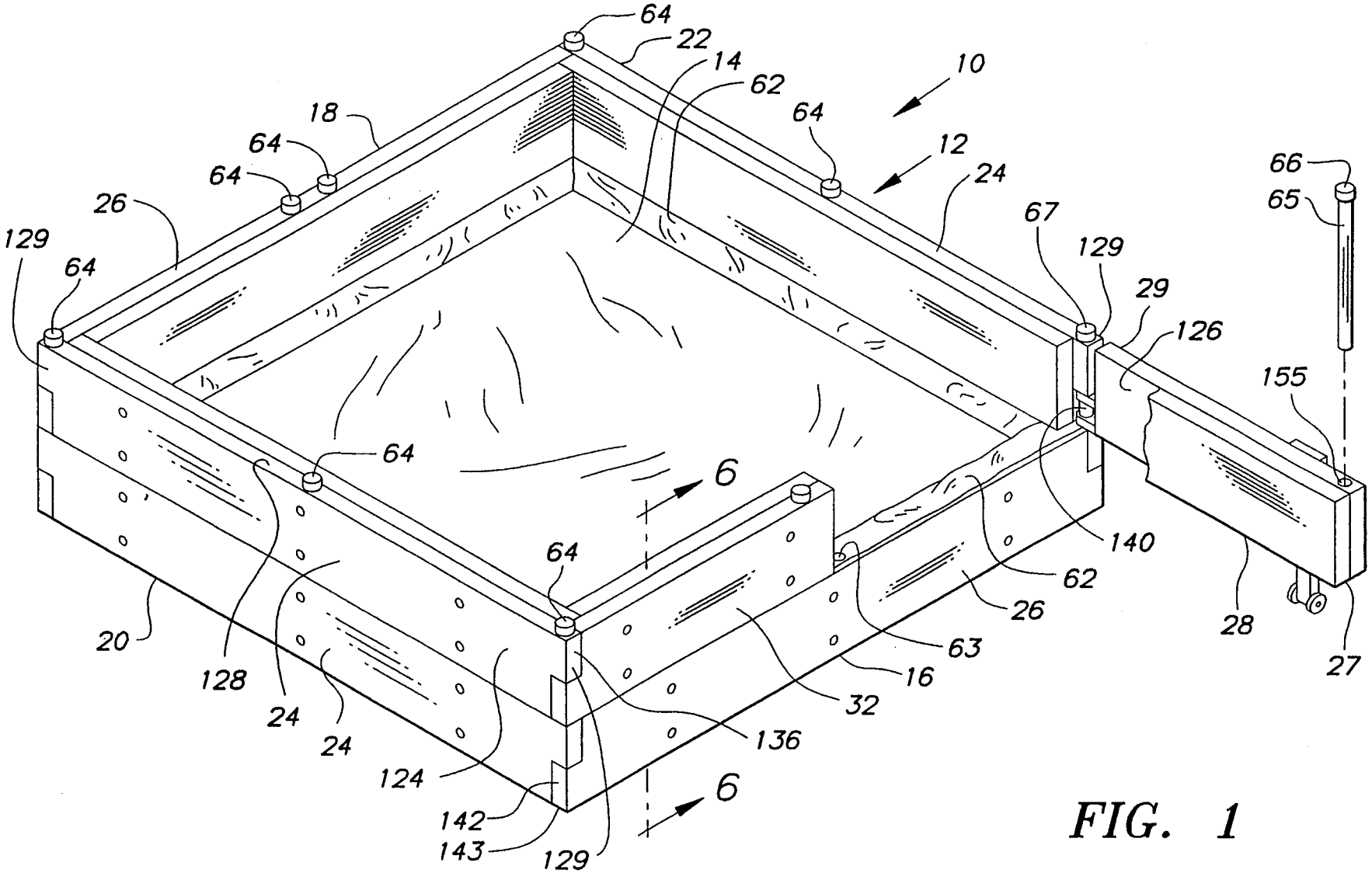
FIG. 1 is a perspective view of a bed according to the invention, with a partial cutaway and partial explosion.

With reference to FIG. 1, there is depicted a bed 10 of the invention having a rectangular mattress 14 and a wall 12. Wall 12 extends around and immediately adjacent to the entire periphery of mattress 14. Mattress 14 and wall 12 preferably both rest on the floor. Wall 12 has four wall sections. Each wall section corresponds to one side of rectangular mattress 14. The wall sections are front wall section 16, rear wall section 18, first side wall section 20, and second side wall section 22. Front wall section 16 is joined at its respective ends to ends of first side wall section 20 and second side wall section 22.

Rear wall section 18 is joined at its respective ends to opposite ends of first side wall section 20 and second side wall section 22. Each wall section is at a right angle to the adjacent wall section. It will be seen that wall 12 is constructed in two courses of panels. First side wall section 20 is constructed of side wall panels 24 in two courses. Second side wall section 22 is constructed of side wall panels 24 in two courses. Rear wall section 18 is constructed of front/rear wall panels 26 in two courses. Front wall section 16 has a first, or lower, course of front/rear wall panel 26. A second course of front wall section 16 is constructed of gate panel 28 on the side adjacent to second side wall section 22 and half panel 32 on the side adjacent to first side wall section 20.

Figure 2:
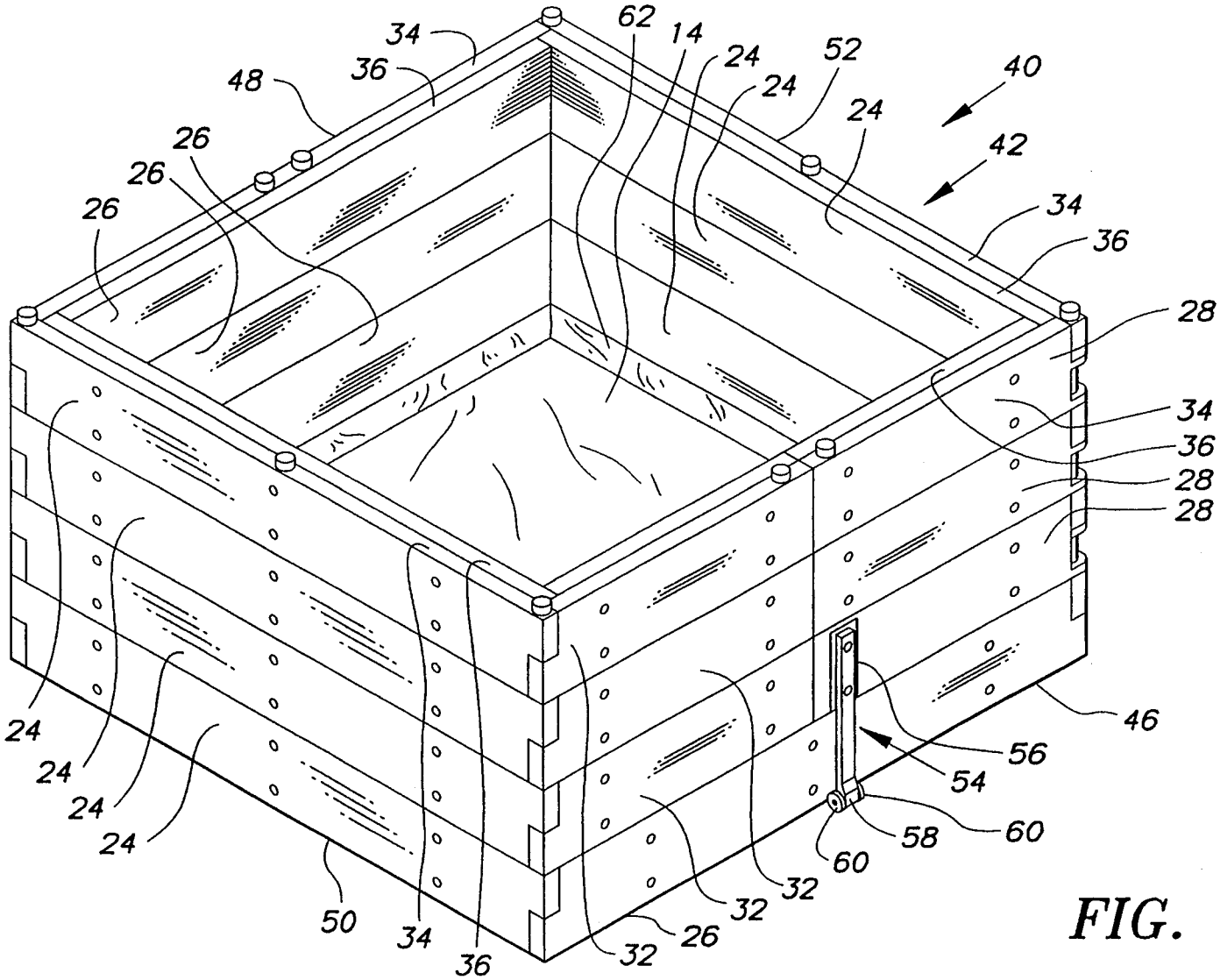
FIG. 2 is a perspective view of a bed according to the invention.

With reference to FIG. 2, a bed 40 according to the invention having rectangular mattress 14 and a wall 42 constructed of four courses of panels is depicted. Wall 42 has front wall section 46, rear wall section 48, first side wall section 50, and second side wall section 52. Front wall section 46 is joined at its respective ends to ends of first side wall section 50 and second side wall section 52. Rear wall section 48 is joined at its respective ends to opposite ends of first side wall section 50 and second side wall section 52. First side wall section 50 is constructed of four courses of side wall panels 24. Second side wall section 52 is constructed of four courses of side wall panels 24. Rear wall section 48 is constructed of four courses of front/rear wall panels 26. Front wall section 46 is constructed of four courses of panels. The first, or lowest, course is a front/rear wall panel 26. Each of three courses above the first course is constructed of a gate panel 28 on the side adjacent to second side wall section 52 and a half panel 32 on the side adjacent to first side wall section 50.

The lowest of the gate panels 28 is supported by gate support 54. Gate support 54 is a substantially vertical member attached at an upper end 56 to lowest gate panel 28, and near a lower end 58 having two wheels 60 rotatably mounted thereon.

Each panel 24, 26, 28 and 32 has an exterior rigid structural section 34 and interior padding section 36. Engaging members, explained below, are provided on the rigid structural section of each panel, other than gate panels, for end-to-end engagement of adjacent panels in each course. Padding sections 36 are disposed so that substantially all of an interior side of wall 12 is provided with padding. The padding is provided over the entire height of each panel. On each side wall panel 24, the padding extends substantially to each end of the panel. On front/rear wall panels 26, the padding is recessed from each end to accommodate the padding of the adjacent side wall panel. On half panels 32, the padding is recessed at an end adjacent to a side wall section to accommodate the padding of the adjacent side wall panel, and extends substantially to the opposite end of the panel. On each gate panel 28, the padding extends to the end of the panel at a latch end 27, and is recessed from the end of the panel at a hinge end 29, to accommodate the padding on adjacent side wall panel 24.

Referring to FIG. 1, the exterior rigid structural section 34 of each panel is substantially a rectangular block, having an outer side 124, an inner side 126 (shown on gate panel 28 where padding section 36 is broken away), a top surface 128, a bottom surface (not shown), and first and second ends. Side wall panels 24 have engaging members 129 projecting from the top half of each end. An extension of top surface 128 provides a top surface of the engaging members 129. The end surface of the engaging member is a vertical, rectangular surface 136. A lower surface of the engaging member is a horizontal rectangular surface (not shown). A lower half of each end of the panel 24 has a vertical rectangular end surface 140. The side surfaces of the engaging members are extensions of the outer side surface and the inner side surface of the panel.

Each front/rear wall panel 26 has an engaging member 143 projecting horizontally from the lower half of each of its ends. Engaging member 143 thus has a bottom surface that is an extension of the bottom surface of the panel, a vertical rectangular end surface 142, and a horizontal rectangular top surface. A vertical rectangular end surface is provided on an upper half of each end of the panel 26.

Each half panel 32 has, at a first end, a horizontal projecting engaging member identical to the engaging member of a front/rear wall panel 26. A second end of each half panel 32 has a continuous vertical rectangular end surface (not shown).

Vertical support members 64 are provided at each intersection of adjacent wall sections. Each engaging member has a cylindrical vertical aperture 154 (shown in FIG. 4) therethrough. Aperture 154 is of sufficient diameter to accommodate a vertical support member 64. Vertical support members 64 disposed through the engaging members thus cooperate with the engaging members to engage adjacent panels in each course rigidly with respect to one another. Support members 64 are also provided centrally in each of side wall section 20 and 22. A cylindrical vertical aperture is provided through the center of the rigid structural section 34 of each of side wall panels 24 to accommodate a support member 64. Two vertical support members 64 are provided near the center of the rear wall section 18. Two cylindrical vertical apertures are provided through the rigid structural section of each front/rear wall panel 26. As may be seen, the vertical support members 64 maintain panels in successive courses in vertical alignment. The vertical support members also serve to spread the force of any impact over all of the panels. Each vertical support member is provided with a cap 66 that fits over the top of the support members. This cap 66 prevents items from falling into the interior of a hollow supporting member.

In front wall section 16, a vertical support member is provided through half wall panel 32 near its end adjacent to gate panel 28. This support member also passes through panel 26, which has two centrally-disposed vertical cylindrical apertures.

A vertical support member, referred to as latch member 65, is provided through gate panel 28 near latch end 27 thereof. Latch member 65 may be placed through an aperture 155 provided in gate panel 28 and through an aperture provided in panel 26, so as to maintain gate panel 28 latched in a closed position. Latch member 65 may be lifted clear of panel 26 to allow gate panel 28 to open.

With reference to FIG. 2, it will be seen that vertical support members are provided that are slightly longer than the height of four panels. When opening the gate shown in FIG. 2, latch member 65 may be allowed to project through all three gate panels 28, so as to maintain the gate panels in alignment.

It is desirable to maintain a supply of vertical supporting members in each length that may used at a given facility.

The vertical support members may be of any suitably rigid material. It has been found desirable to make the vertical support members from one-and-a-quarter inch PVC pipe. Caps 66 may be made from one-and-a-quarter inch PVC pipe caps.

When the wall is assembled as shown in FIG. 1 or FIG. 2, the inner side surface of each engaging member will be parallel to and in close proximity to an end surface of the adjacent panel in that course. The bottom surface of each engaging member of each side wall panel will be resting directly on the top surface of the engaging member of a front/rear wall panel or a half panel, as the case may be. This design of engaging members, and the providing of vertical support members cause the adjacent panels in each course, other than gate panels, to be rigidly mounted with respect to one another. This gives stability to the wall.

Figure 3:
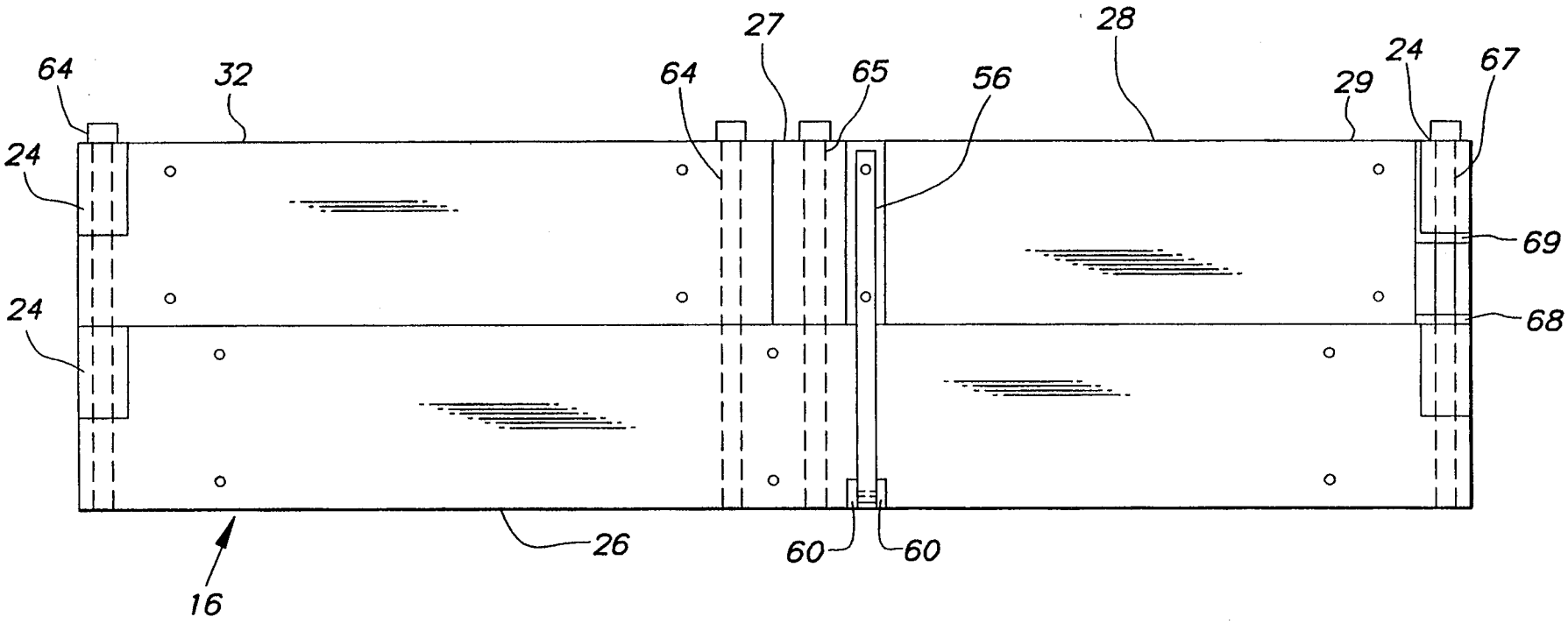
FIG. 3 is a front elevational view of a bed according to the invention.

With reference to FIG. 3, there is depicted an enlarged front elevational view of a bed according to the invention, in the embodiment shown in FIG. 1. The first course of front wall section 16 is provided by a front wall panel 26. The second course of front wall section 16 is provided by a gate panel 28 on the right side, and half panel 32 on the left side. Two vertical supporting members 64, hinge member 67, and latch member 65, are shown in dashed lines. Supporting members 64 and latch member 65 are disposed interior to the rigid section 34 of each panel in vertical apertures extending the height of each panel. Hinge vertical supporting member 67 is partially visible at hinge end 29 of gate panel 28.

The structure of gate panel 28 will now be explained. The structure of gate panel 28 may be seen in FIG. 1, where a portion of the padding section 34 of gate panel 28 is cut away, and in FIG. 3. Gate panel 28 has a latch end 27 and a hinge end 29. It will be seen that each gate panel 28 has two hinge members 68 and 69 projecting horizontally from its hinge end. Hinge members 68 and 69 may also be referred to as hinge engaging members. Lower hinge member 68 projects from the lower edge of the hinge end. Upper hinge member 69 projects from hinge end 29 whereby an upper surface of upper hinge member 69 is substantially at the level of the vertical midpoint of the hinge end. Each hinge member 68, 69 has a shape, when viewed from above, having two parallel sides extending from the end of gate panel 28, and a substantially semi-circular periphery joining the two parallel sides opposite to gate panel 28. Each hinge member 68, 69 also has a central circular hole large enough to allow the passage of hinge vertical supporting member 67. A space is provided between the hinge end of gate panel 28 and the interior surface of adjacent side wall panel 24, whereby gate panel 28 will rotate freely about hinge vertical supporting member 67.

A vertical supporting member 64 is provided through half panel 32 and front/rear wall panel 26 near the latch end of half panel 32. This vertical supporting member serves to keep half panel 32 in vertical alignment with front/rear wall panel 26. A vertical cylindrical aperture is provided through the rigid section of front/rear wall panel 26 to accommodate this vertical supporting member 64. As noted above, there are two central vertical apertures provided in each front/rear wall panel 26. As a result, these front/rear wall panels 26 may be used interchangeably as the first course in front wall section 36 or as any course in rear wall section 18.

Figure 4:
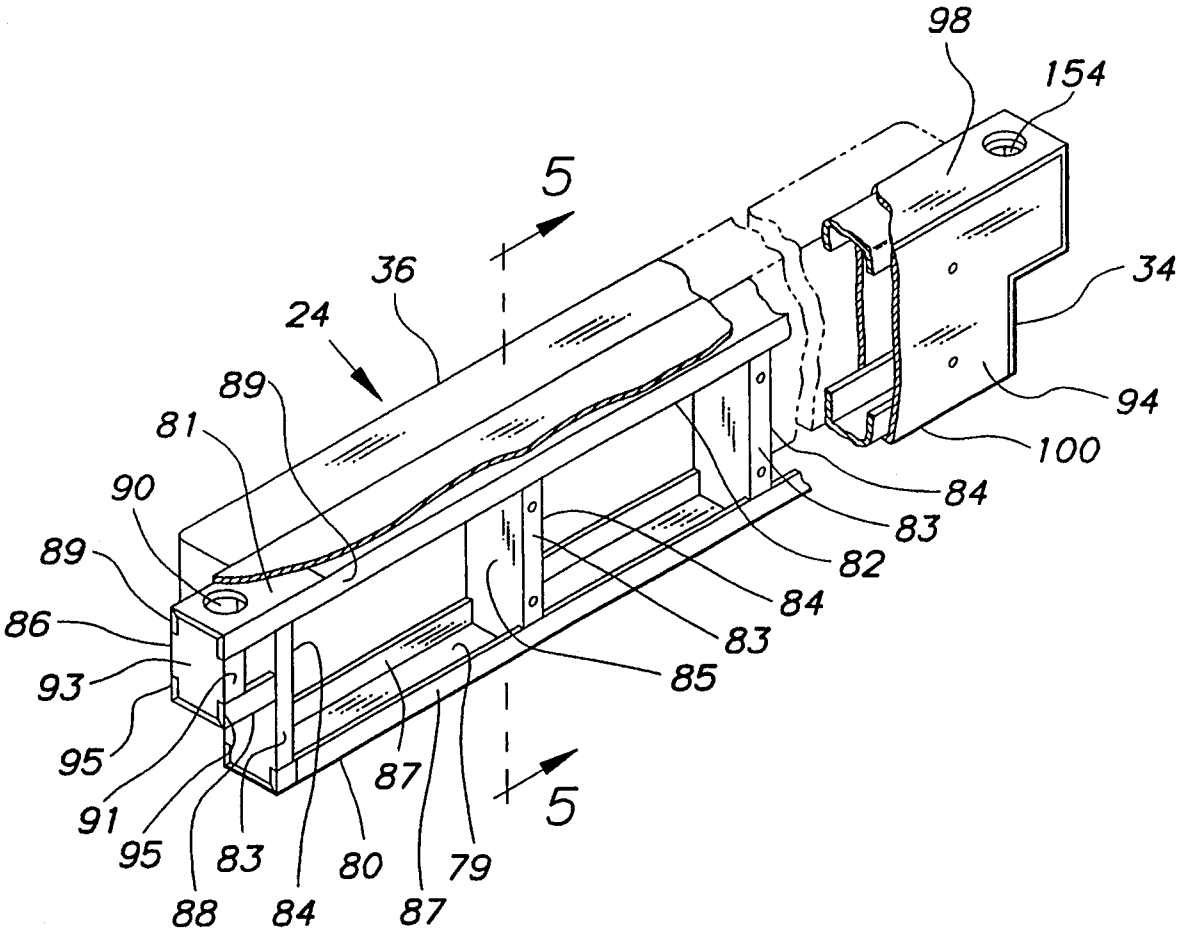
FIG. 4 is a perspective view of a panel of a bed according to the invention with a partial cut-away.

With reference to FIG. 4, the structure of the rigid section 34 of a side wall panel 24 will now be explained. A foot member 80 and a top member 82 are provided parallel to each other the length of the panel. A number of vertical studs 84 extend vertically at intervals between the foot member 80 and the top member 82. Side wall panel 24 has projecting engaging members extending from the upper part of each end thereof. Consequently, the top member 82 extends beyond the end of the last of studs 84 at each end of the panel. Extending vertically downward from the end of top member 82 is an engaging member stud 86 half the length of studs 84. A short central horizontal member 88 joins a lower end of engaging member stud 86 and a central portion of the last of vertical studs 84. Circular holes 90 are provided in the extension of top member 82 and central horizontal member 68 to permit the passage of vertical support members.

The structural members, including foot member 80, top member 82, vertical studs 84, engaging member stud 86 and central horizontal member 88, are all desirably made of a strong, relatively lightweight, metal. For example, aluminum channel may be used. Aluminum channel has a long, planar base having parallel sides, and two planar flanges projecting at a right angle from each side of the base. Convenient construction may be provided by the removal of the flanges 83 of each vertical stud 84 within a short distance of each end thereof. The end of the base 85 of the vertical stud 84 abuts the surface of the base 79 of foot member 80 and the surface of the base 81 of top member 82. Where the flanges 83 of each vertical stud 84 have been removed, the base 85 of each vertical stud 84 will then fit, at a lower end, between the flanges 87 of foot member 80 and, at an upper end, between the flanges 89 of top member 82. The edges of the base of each vertical stud 84 abut the interior of the flanges of foot member 80 and top member 82. Structural members may be welded to one another where they abut. The ends of the flanges 91 of engaging member stud 86 may be similarly removed so that the ends of the base 93 of engaging member stud 86 fit between flanges 89 of top member 82 and the flanges 95 of horizontal member 88.

A covering completely surrounds the structural members of the panel, with the exception of the holes 90. Thus outer planar cover plate 94 on the outer side of the panel, planar inner cover plate 96 on the inner side of the rigid section of the panel, planar top cover plate 98, a planar bottom cover plate 100, a planar upper vertical cover plate on engaging member stud 86, a planar lower vertical cover plate on the last of studs 84, and a planar horizontal cover plate on the horizontal member 88 are provided. The cover plates are secured to the structural members with an adhesive. The cover plates are desirably a rigid, substantially unbreakable, plastic material that is washable and impervious to moisture. Excellent results have been achieved using FRP board for the cover plates. The adhesive employed is FRP adhesive.

Figure 5:
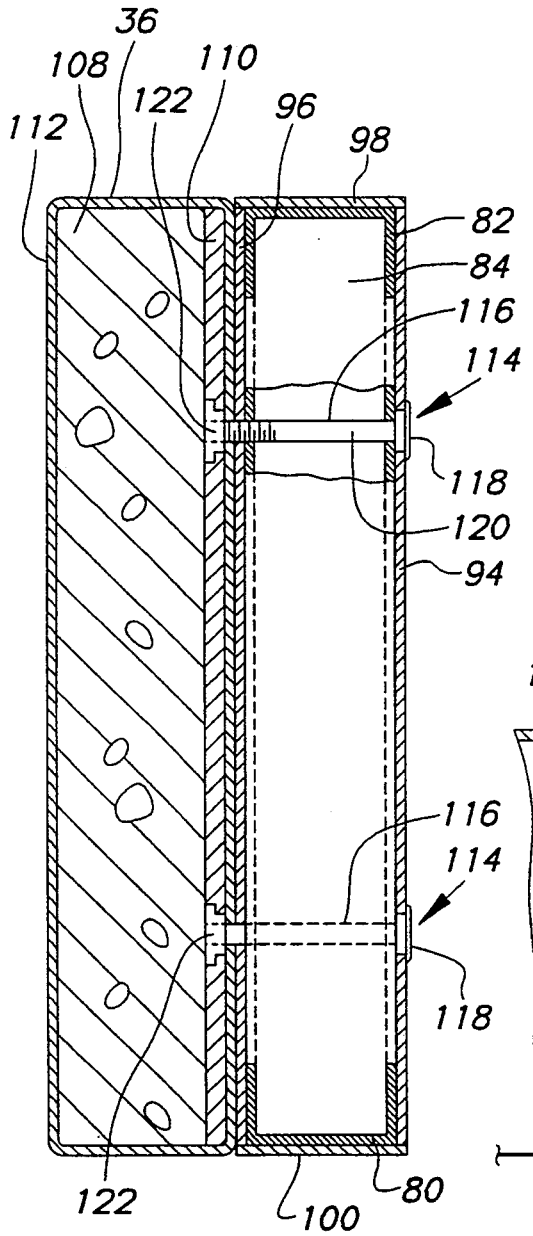
FIG. 5 is a cross-section, taken along line 5—5 of FIG. 4, of a panel of a bed according to the invention.

Additional features of the structure of a panel will now be explained with reference to FIG. 5. It will be seen with reference to FIG. 5, that padding section 36 includes foam 108, a rigid backer 110, and a covering 112. The rigid backer 110 is a substantially rectangular piece of rigid material. Plywood in thickness of one-quarter inch may be used for the rigid backer 110. The covering 112 completely surrounds the foam and the rigid backer 110. The covering 112 is stapled to the side of the rigid backer 110 opposite to foam 108. The covering 112 is desirably a self-sanitizing sheeting that provides a moisture barrier. For example, the self-sanitizing waterproof laminated sheeting sold under the trademark STAPH-CHEK XL, a registered trademark of Herculite Products, Inc., may be used.

The rigid section 34 and padding section 36 are joined together by means of fasteners 114. Fasteners 114 include pins 116, having heads 118 and rods 120. Rods 120 are threaded at an end opposite to heads 118. Fasteners 114 have heads 118 projecting from outer cover plate 94. Rod 120 extends through the structural members of the panel. A T-nut 122, having a threaded boss, is joined to rod 120 through a hole in rigid backer 110. For a rigid backer 110 made of plywood, when the combination of the T-nut and the pin is tightened, the arms of the T-nut will be recessed into the plywood.

It has been found that panels of this construction, approximately one foot in height, and suitable in dimension for a substantially standard mattress, will be lightweight. Such panels have been found to weigh in the range of 25 to 30 pounds, approximately. As a result, a wall of a bed according to the invention may be assembled by members of the nursing staff, who may not have as great physical strength as members of the maintenance staff. This allows beds to be assembled even when members of the maintenance staff are not available. The beds may be disassembled relatively easily as well. The panels are more convenient to store and transport than the single-piece walls and base used in the prior bed having wooden structural members. Moreover, no base is required in a bed according to the invention.

Because the walls of the bed are modular, the various panels may be used in beds having varying numbers of courses. This allows flexibility depending on the particular population of brain-injury patients at a given facility at a given time.

Higher walls, having more courses, are required for move active brain-injury patients. Higher walls are also desirable in reducing the light and noise reaching patients.

In both FIGS. 1 and 2 it will be seen that a waste sheet 62 is provided. Waste sheet 62 is disposed under the mattress, between the mattress and the lowest course of panels, and between the lowest course of panels and the second course of panels. Openings, such as opening 63 on FIG. 1, are provided in the waste sheet as appropriate for the passage of vertical support members. The waste sheet may be made of any suitable material that forms a moisture barrier. Polyethylene film may be used, for example.

Figure 6:
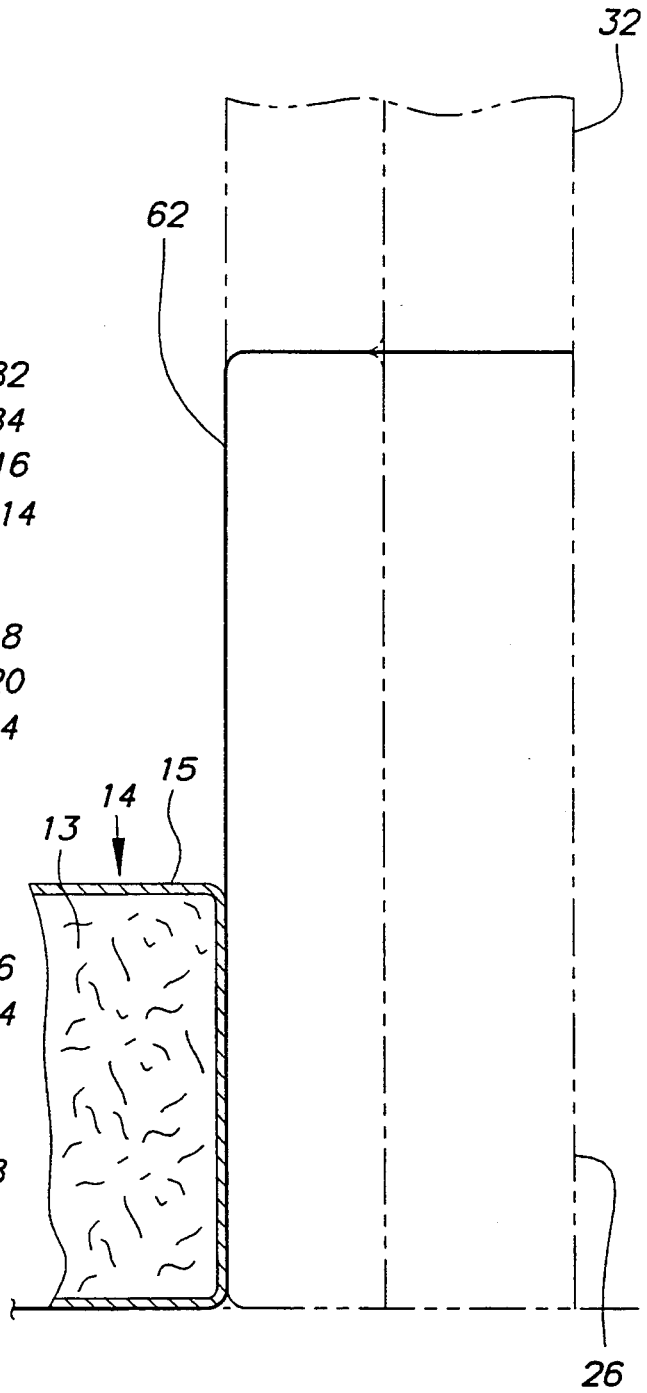
FIG. 6 is a partial cross-section, taken along line 6—6 of FIG. 1, of a wall and a mattress of a bed according to the invention.

FIG. 6 shows the relationship among the mattress, the waste sheet, and the first course of panels. The mattress 14, shown partially on the left-hand side of the figure, has a central foam padding 13 and an exterior covering material 15. The waste sheet 62 is shown under the mattress, between the mattress and the padding of a panel 26 in the first course of panels, and extending between the panels in the first and second course. The panels, having already been described, are shown in outline only in FIG. 6. The waste sheet thus serves to collect any liquids, such as patient wastes. The waste sheet may be removed by partial disassembly of the wall of the bed. This includes lifting the supporting rods and the panels.

It will be appreciated that there are considerable variations that can be accomplished in an article of the invention without departing from its scope. As a result, although a preferred embodiment of an article according to the invention has been described above, it is emphasized that the invention is not limited to a preferred embodiment and there exist alternative embodiments that are fully encompassed within the invention's scope, which is intended to be limited only by the scope of the appended claims.

What is claimed is:

1. A bed, comprising:

(a) a mattress, disposed horizontally;

(b) a wall, disposed vertically, and extending about all of said mattress, said wall comprising:

(i) a plurality of lightweight panels disposed in a plurality of courses, said panels being arranged in end-to-end relation in each of said courses, each one of said panels comprising a rigid structural section on a side of said wall facing outward from said mattress and padding on a side of said wall facing said mattress, said padding being provided over substantially all of said side of said wall facing said mattress, said padding having a washable covering substantially impermeable to moisture; said rigid structural section shaving a washable surface substantially impermeable to moisture; and (ii) engaging means for removably maintaining adjacent ones of said panels in each course rigidly engaged with respect to one another;

wherein said wall further comprises a front wall section having a first end and a second end comprising, in a first course a front wall panel rigidly secured at each end, and a gate panel and a half panel in at least one course above the first course, said gate panel hingedly mounted at a hinge end thereof and openably latched at a latch end thereof opposite to said hinge end, a rear wall section having a first end and a second end, said first end of said first side wall section being rigidly joined to said first end of said front wall section and said second end of said first side wall section being rigidly joined to said first end of said rear wall section, and a second side wall section having a first end and a second end, said first end of said second side wall section being rigidly joined to said second end of said front wall section and said second end of said second side wall section being rigidly joined to said second end of said rear wall section, said wall sections forming right angles to one another where the wall sections are joined.

2. A bed as recited in claim 1, wherein some of said panels comprise an engaging member, having a vertical planer inner side surface, projecting from each end thereof, a vertical planar end surface at each end thereof adjacent to said engaging member thereof, whereby said inner side surface of said engaging member is situated assembled facing said end surface of an adjacent panel.

* * * * *